US006127979A

United States Patent [19]

Zhou et al.

[11] Patent Number: 6,127,979

[45] Date of Patent: Oct. 3, 2000

[54] ANTENNA ADAPTED TO OPERATE IN A PLURALITY OF FREQUENCY BANDS

[75] Inventors: Guangping Zhou, Arlington Hts; Robert Kenoun, Palatine; Zhengping Ding, Waukegan, all of Ill.; Wayne Huang, San Diego, Calif.; Anhtuan Trandai, Kechubong, Singapore; Daniel P. Groebe, Chicago, Ill.

[73] Assignee: Motorola, Inc., Schaumburg, Ill.

[21] Appl. No.: 09/032,162

[22] Filed: Feb. 27, 1998

[51] Int. Cl.[7] ..... H01Q 1/24

[52] U.S. Cl. ..... 343/702; 343/895; 343/725

[58] Field of Search ..... 343/702, 895, 343/725, 900, 726, 729; H01Q 1/24

[56] References Cited

U.S. PATENT DOCUMENTS

| | | | |
|---|---|---|---|
| 2,419,611 | 4/1947 | Walsh | 343/745 |
| 4,121,218 | 10/1978 | Irwin et al. | 343/702 |
| 4,229,743 | 10/1980 | Vo et al. | 343/749 |
| 4,868,576 | 9/1989 | Johnson, Jr. | 343/702 |
| 5,446,469 | 8/1995 | Makino | 343/702 |
| 5,583,520 | 12/1996 | Thill | 343/702 |
| 5,594,457 | 1/1997 | Wingo | 343/702 |
| 5,612,704 | 3/1997 | Cole | 343/702 |
| 5,710,567 | 1/1998 | Funke | 343/702 |

FOREIGN PATENT DOCUMENTS

| | | | |
|---|---|---|---|
| 22843/70 | 6/1972 | Australia . | |
| 635 898A1 | 1/1995 | European Pat. Off. . | |
| 790666 A1 | 8/1997 | European Pat. Off. | H01Q 1/36 |
| 2253949 | 9/1992 | United Kingdom . | |
| 94/10720 | 5/1994 | WIPO . | |
| 97/00542 | 1/1997 | WIPO . | |
| 97/18601 | 5/1997 | WIPO . | |

*Primary Examiner*—Hoanganh Le
*Attorney, Agent, or Firm*—John King; Daniel Collopy

[57] ABSTRACT

The present disclosure is related to an antenna (129) adapted to receive signals in multiple frequency bands, and comprises a fixed whip antenna (406) and a helical coil antenna (408) coupled to a single feedpoint. The antenna may also include a monopole common to the fixed whip antenna and the helical coil antenna. A single matching circuit (130) is adapted to provide matching for both the whip antenna and the helical coil antenna. According to one embodiment, the antenna can also be reduced in size by attaching a disc (704) to the end of the whip portion of the antenna, while decreasing the pitch of the helical coil. Finally, a clip (210) can be used below a threaded nut of a housing to provide a feed point for the antenna to further reduce the electrical lengths of the fixed whip antenna and a helical coil antenna.

19 Claims, 4 Drawing Sheets

ANTENNA ADAPTED TO OPERATE IN A PLURALITY OF FREQUENCY BANDS

FIELD OF THE INVENTION

This application is related to an antenna, and more particularly to an antenna adapted to operate in more than one frequency band.

BACKGROUND OF THE INVENTION

With the increased use of wireless communication devices, spectrum has become scarce. In many cases, network operators providing services on one particular band have had to provide service on a separate band to accommodate its customers. For example, network operators providing service on a GSM system in a 900 MHz frequency band have had to rely on a DCS system at an 1800 MHz frequency band. Accordingly, wireless communication devices, such as cellular radio telephones, must be able to communicate at both frequencies, or even a third system, such as PCS 1900. Such a requirement to operate at two or more frequencies creates a number of problems. For example, the wireless communication device must have an antenna adapted to receive signals on more than one frequency band.

Also, as wireless communication devices decrease in size, there is a further need to reduce the size of an antenna associated with the device. Further, while an extendible antenna offers certain advantages, such an antenna poses problems to an end user. Because the antenna will typically perform better when in the extended position, the user is required to extend the antenna before operating the wireless communication device. As a result, many end users prefer a fixed or "stubby" antenna which do not need to be extended during operation. Accordingly, there is a need for a small antenna adapted to receive signals in multiple frequency bands.

DESCRIPTION OF THE PREFERRED EMBODIMENT

The present disclosure is related to an antenna adapted to receive signals in multiple frequency bands. In particular, the antenna preferably comprises a fixed whip antenna and a helical coil antenna coupled to a single feedpoint. A single matching circuit is adapted to provide matching for both the whip antenna and the helical coil antenna, while also providing static protection. According to one embodiment, the antenna can also be reduced in size by attaching a disc to the end of the whip portion of the antenna, while decreasing the pitch of the helical coil. A dielectric material preferably surrounds the whip portion and provides support for the helical coil antenna. An attachment member allowing the antenna to be coupled to the wireless communication device acts as a monopole which is top loaded with the fixed whip antenna and the helical coil antenna. Finally, a clip can be used to provide a feed point for the antenna to further reduce the electrical lengths of the fixed whip antenna and a helical coil antenna.

Figure 1:
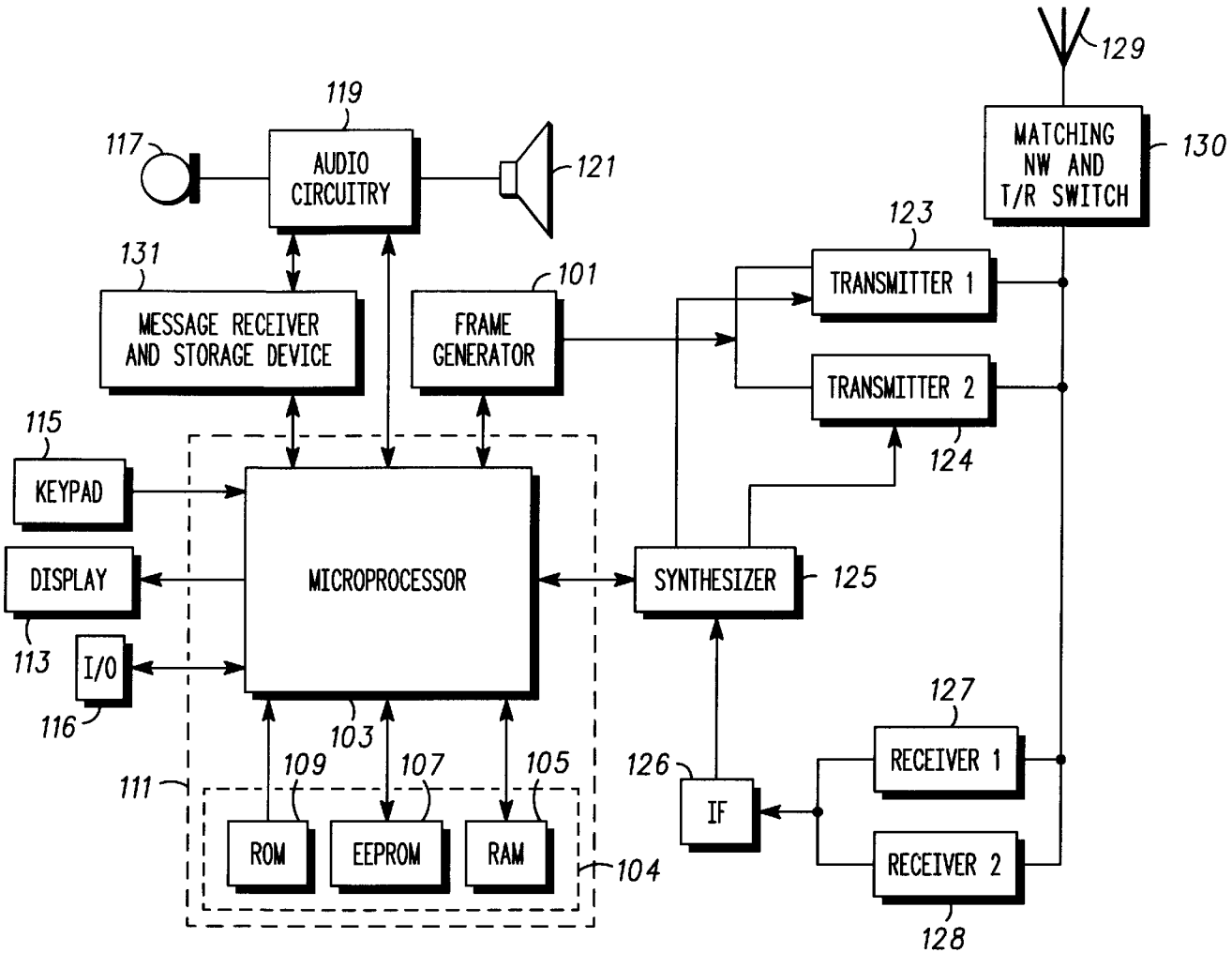
FIG. 1 is a block diagram of a wireless communication device, such as a cellular radio telephone, according to the present invention.

Turning first to FIG. 1, a block diagram of a wireless communication device such as a dual band cellular radiotelephone incorporating the present invention is shown. In the preferred embodiment, a frame generator ASIC 101, such as a CMOS ASIC available from Motorola, Inc. and a microprocessor 103, such as a 68HC11 microprocessor also available from Motorola, Inc., combine to generate the necessary communication protocol for operating in a cellular system. Microprocessor 103 uses memory 104 comprising RAM 105, EEPROM 107, and ROM 109, preferably consolidated in one package 111, to execute the steps necessary to generate the protocol and to perform other functions for the communication unit, such as writing to a display 113, accepting information from a keypad 115, controlling a frequency synthesizer 125, or performing steps necessary to amplify a signal according to the method of the present invention. ASIC 101 processes audio transformed by audio circuitry 119 from a microphone 117 and to a speaker 121.

A transceiver processes the radio frequency signals. In particular, transmitters 123 and 124 transmit through an antenna 129 using carrier frequencies produced by a frequency synthesizer 125. Information received by the communication device's antenna 129 enters receivers 127 and 128 through a matching network and transmit/receive switch 130. A preferred matching network and transmit/receive switch 130 will be shown in more detail in FIG. 10. Receivers 127 and 128 demodulate the symbols comprising the message frame using the carrier frequencies from frequency synthesizer 125. The transmitters and receivers are collectively called a transceiver. The communication device may optionally include a message receiver and storage device 131 including digital signal processing means. The message receiver and storage device could be, for example, a digital answering machine or a paging receiver.

Figure 2:
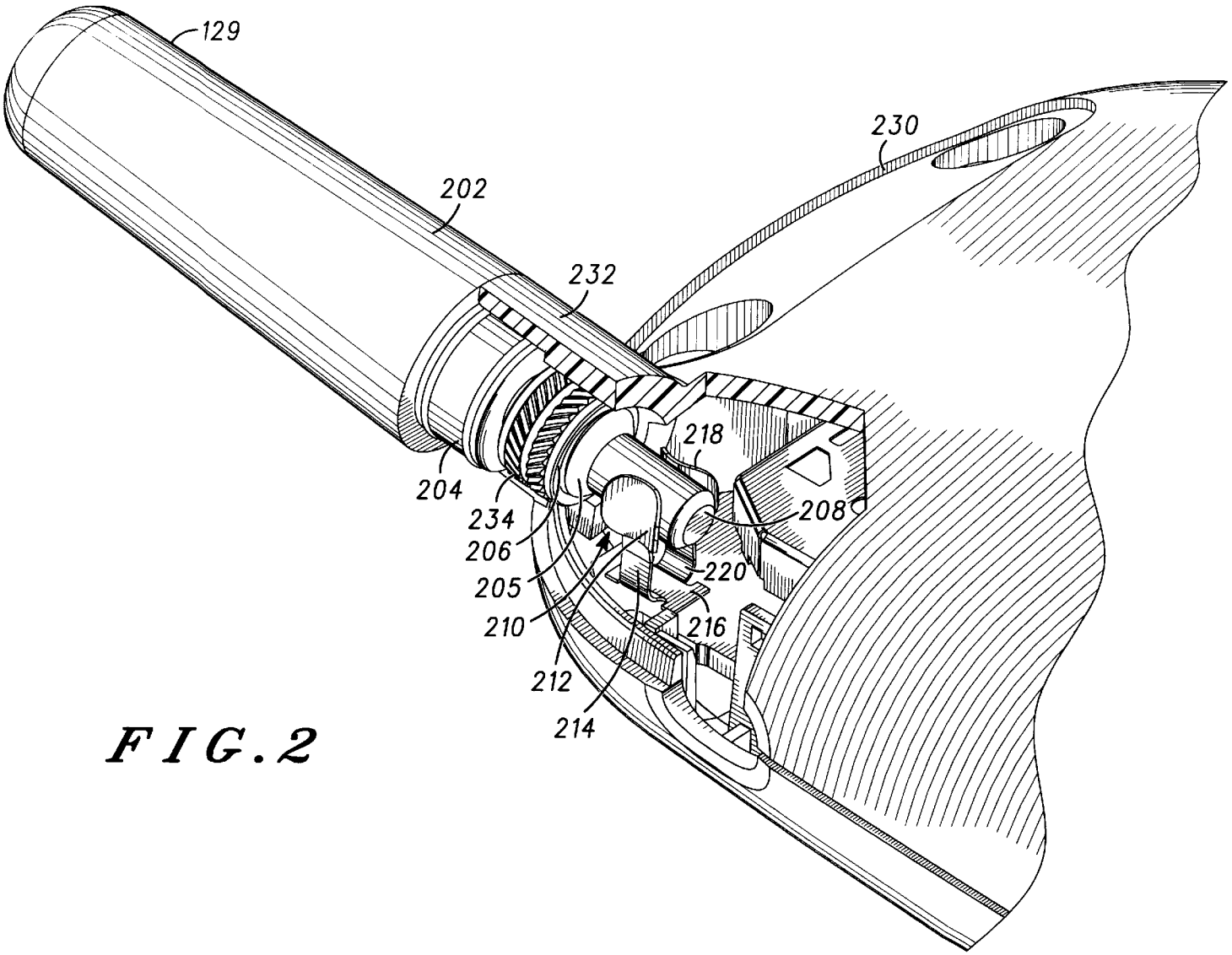
FIG. 2 is a partial perspective view of an antenna coupled to the wireless communication device of FIG. 1.

Turning now to FIG. 2, a partial cross-sectional view shows an antenna according to the present invention coupled to a wireless communication device, such as that shown in FIG. 1. Antenna 129 comprises an outer housing or overmold 202 having a sleeve 204. A monopole 205 comprises a threaded portion 206 which extends to a coupling portion 208. The length of the monopole generally effects vertical polarization, where a longer monopole generally provides greater vertical polarization. The monopole will be described in more detail in reference to the remaining figures.

The antenna is coupled to a clip 210 having a contact element 212 at the end of a flexible arm 214 which is coupled to a base portion 216. Base portion 216 is preferably attached to a circuit board having the circuitry of FIG. 1 or some other suitable circuit. Bracket 210 further includes a second contact 218 coupled to flexible arm 220 which also extends to base portion 216. Coupling portion 208 is retained by flexible arms 214 and 220 which also provide an electrical contact. The dimensions of the flexible arms are preferably selected to optimize the efficiency of the antenna. That is, the length and width of the flexible arms are selected to provide the proper inductance or capacitance for the antenna, where a narrower arm provides greater inductance and wider arm provides greater capacitance.

FIG. 2 also shows a housing 230 of the wireless communication device of FIG. 1. The housing includes a receiving sleeve 232, shown in partial cross-section, which retains a threaded nut 234 for receiving threaded portion 206 of the antenna. Although the feed point of the antenna is preferably made at contact elements 212 and 218 near the base of coupling portion 205, the feed point could be made at the threaded nut 234 according to the present invention.

Figures 3, 4, 5, 6:
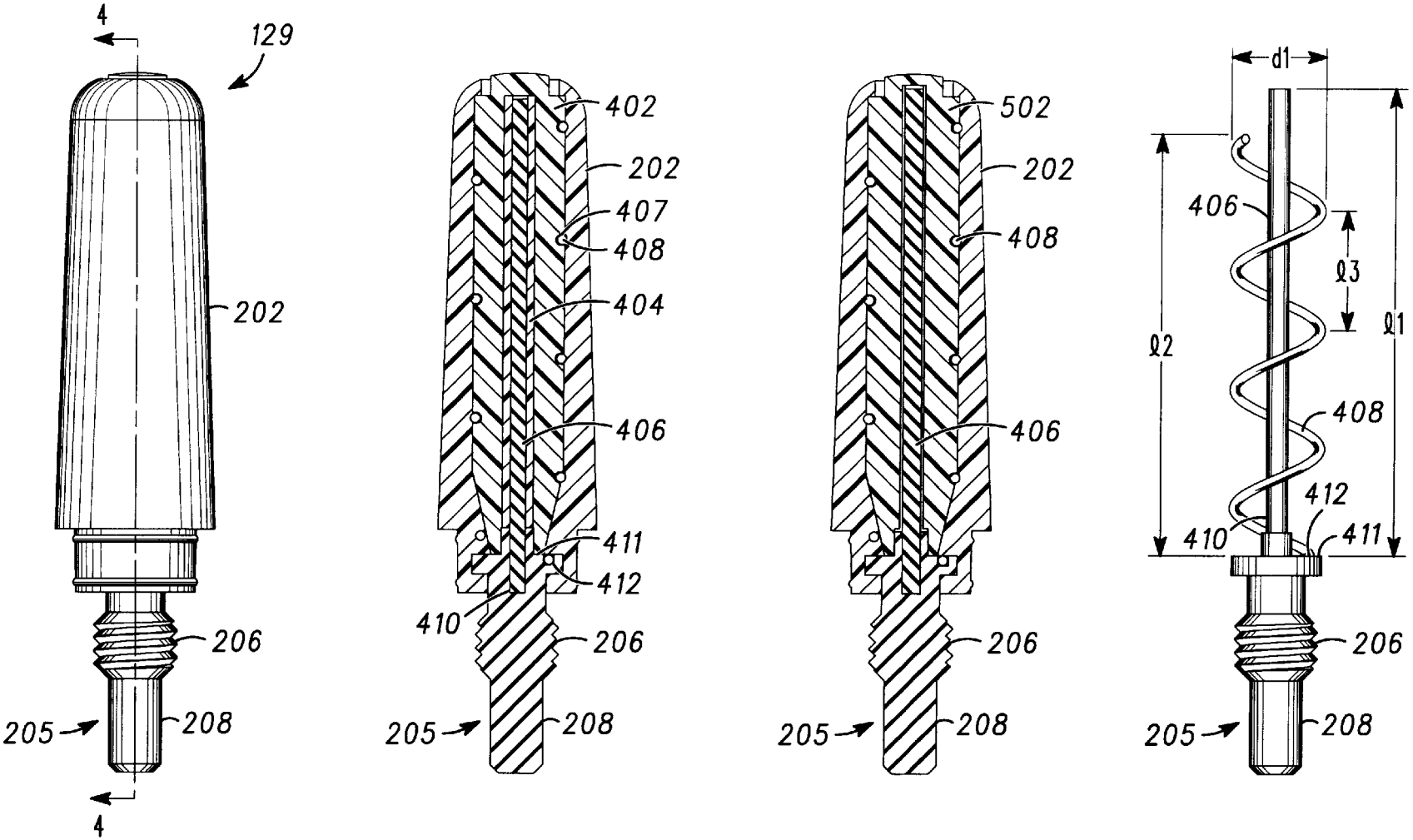
FIG. 3 is a plan view of an antenna according to the present invention.
FIG. 4 is a cross-sectional view of the antenna of FIG. 3 according to the present invention.
FIG. 5 is a cross-sectional view of an alternate embodiment of the antenna according to the present invention.
FIG. 6 is a plan view of antenna elements of FIG. 5 according to the present invention.

Turning now to FIG. 3, a plan view shows antenna 129 detached from the wireless communication device. A cross-sectional view in FIG. 4 shows the cross-section of one embodiment of the antenna. In particular, a dielectric core 402 within the overmold 202 preferably comprises a dielectric material. For example, the core could be a dielectric material comprising santaprene and polypropylene. For example, the dielectric core could be composed of 75% santoprene and 25% polypropylene to create dielectric material having a dielectric constant of 2.0. Within dielectric core 402 is a dielectric sleeve 404 covering a whip antenna 406 which is a substantially straight wire. For example, dielectric sleeve 404 could be a Teflon material. Dielectric core 402 preferably has a dielectric constant $\in_1$ dielectric sleeve preferably has a dielectric constant $\in_2$, where $\in_1 > \in_2$. In addition to providing a wider bandwidth, dielectric sleeve 404 provides mechanical strength to the antenna. As long as $\in_1 > \in_2$, solid plastic could also be used. Alternatively, the area with the sleeve could remain empty, whereby air which has a dielectric constant of $\in = 1$ would provide good electrical characteristics. Depending upon the bandwidth considerations, the sleeve can also be removed, as will be shown in some of the remaining figures.

Also, within a helical recess 407 formed in dielectric core 402 is a helical coil antenna 408. Although the helical coil antenna is formed on the outer edge of the dielectric core 402, the helical antenna could also be completely surrounded by dielectric core 402. Both the whip antenna and the helical coil antenna are electrically connected to the monopole 205. In particular, a lower portion 410 of the whip antenna is coupled to monopole 205 in a recess in a shoulder portion 411 of the monopole, while a lower portion 412 of helical coil antenna 408 is also coupled to a recess in the monopole. Although the helical coil antenna is shown to substantially surround the whip antenna, the helical coil antenna could be adjacent to the whip antenna.

Turning now to FIG. 5, an alternate embodiment of the cross-sectional view of the antenna is shown. In particular, dielectric sleeve 404 is eliminated, leaving a dielectric core 502 surrounding whip antenna 406.

Turning now to FIG. 6, the perspective view of FIG. 6 shows whip antenna 406 and helical coil antenna 408 according to the present invention without any overmold or dielectric layers. In order to transmit and receive signals in the DCS band (1710–1880 MHz frequencies) and the PCS band (1850–1990 MHz frequencies), the whip 406 antenna 406 is selected to be a length $l_1$ of approximately 28.1 (+/−0.5) mm as measured from the shoulder of the monopole. In order to transmit and receive signals in the GSM band (880–960 MHz frequencies), the helical coil antenna 408 is selected to be a length $l_2$ of approximately 25.4 (+/−.8) mm with a pitch dimension $l_3$ of approximately 7.15 mm and approximately 3.7 turns as also measured from the shoulder of the monopole.

Figure 8:
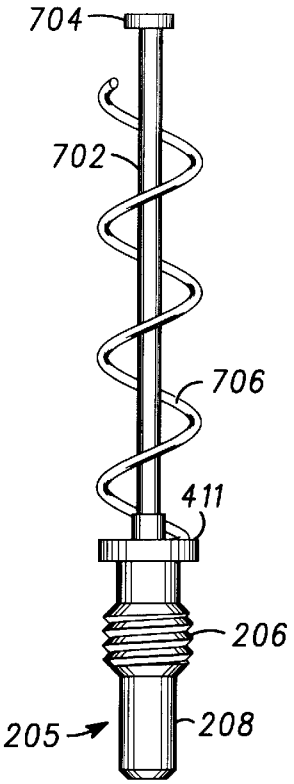
FIG. 8 is a plan view of antenna elements of FIG. 7 according to the present invention.
Figure 7:
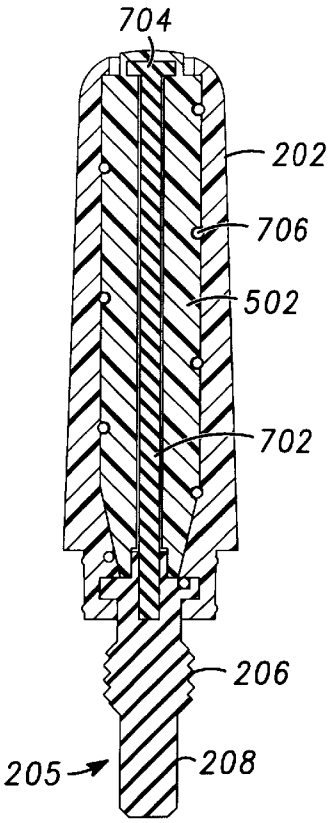
FIG. 7 is a cross-sectional view of an alternate embodiment of the antenna according to the present invention.

Turning now to FIGS. 7 and 8, an alternate embodiment of the present invention shows a shorter whip portion 702 having a disc 704 on the end of the antenna to shorten the overall length of the antenna. The pitch dimension of the helical coil antenna could also be reduced to enable the shortened length of the antenna. Other dimensions for the frequency bands mentioned or other frequency bands could be used according to the present invention.

Figure 9:
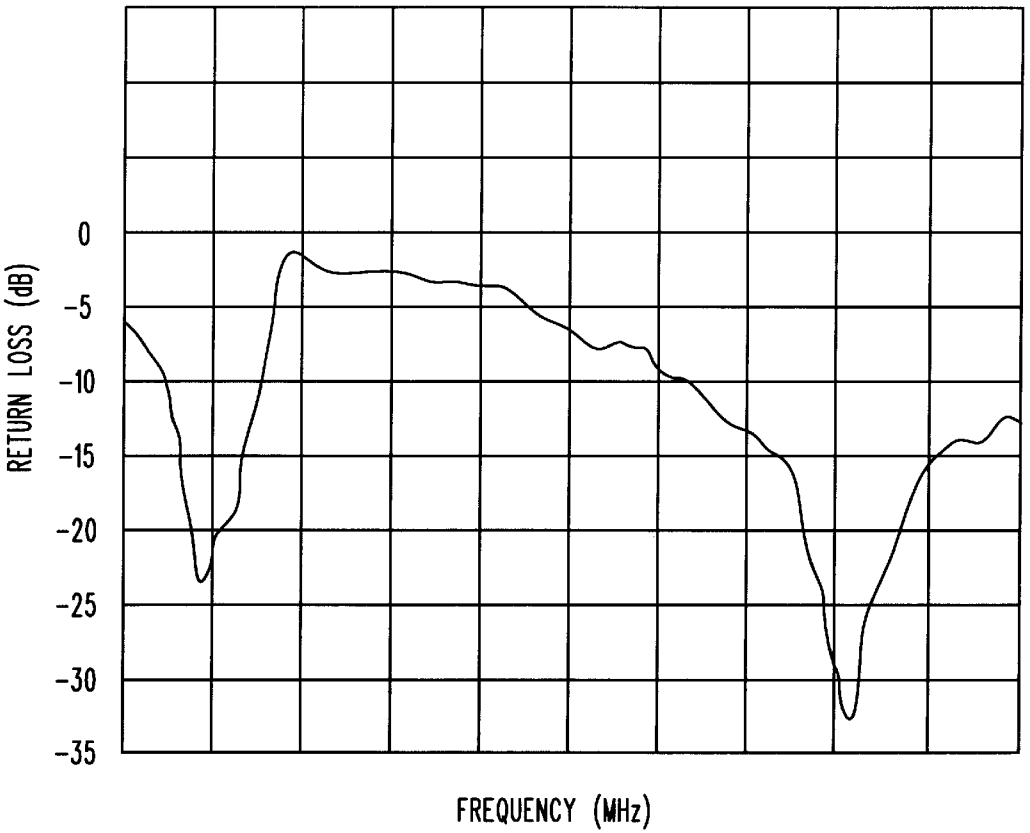
FIG. 9 is a chart showing the frequency response of the antenna of FIG. 5.

Turning now to FIG. 9, a graph shows the return loss in 5 dB increments as a function of frequency according to the antenna of FIG. 5 of the present invention. As can be seen in the figure, the antenna will operate signals between 830–960 MHz band and 1710–2000 MHz band at −10 dB return loss which covers the frequency bands of AMPS, GSM, DCS, PCS, and PHS. With modifying the length of the whip antenna and the helical coil, the resonating frequency can be tuned to any frequency band desired.

Figure 10:
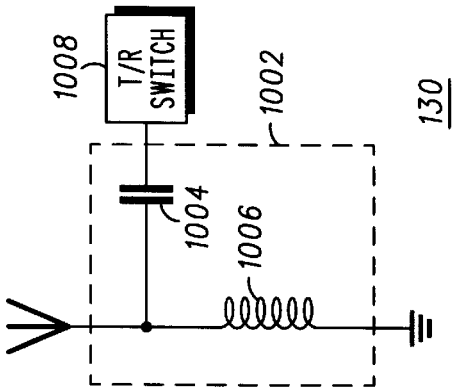
FIG. 10 is a circuit diagram showing the matching circuit of FIG. 1 according to the present invention.

Turning now to FIG. 10, a matching network and transmit/receive switch 130 is shown in more detail. In particular, a matching network 1002 comprising a capacitor 1004 and an inductor 1006. In order to function as a matching network for the GSM, PCS and DCS bands, capacitor 1004 could be approximately 4.7 pf while inductor 1006 is approximately 8.2 nH, for example. Another benefit of the matching network is that the inductor provides a DC path for providing static protection. Finally, any conventional transmit/receive switch 1008 could be used according to the present invention.

In summary, the present disclosure is related to an antenna adapted to receive signals in multiple frequency bands. In particular, the antenna preferably comprises a fixed whip antenna and a helical coil antenna coupled to a single feedpoint. A single matching circuit is adapted to provide matching for both the whip antenna and the helical coil antenna, while also providing static protection. According to one embodiment, the antenna can also be reduced in size by attaching a disc to the end of the whip portion of the antenna, while decreasing the pitch of the helical coil. A dielectric material preferably surrounds the whip portion and provides support for the helical coil antenna. An attachment member allowing the antenna to be coupled to the wireless communication device acts as a monopole which is top loaded with the fixed whip antenna and the helical coil antenna. Finally, a clip can be used to provide a feed point for the antenna to further reduce the electrical lengths of the fixed whip antenna and a helical coil antenna.

Although the invention has been described and illustrated in the above description and drawings, it is understood that this description is by way of example only and that numerous changes and modifications can be made by those skilled in the art without departing from the true spirit and scope of the invention. Although the present invention finds particular application in portable cellular radiotelephones, the invention could be applied to any wireless communication device, including pagers, electronic organizers, or computers. Applicants' invention should be limited only by the following claims.

We claim:

1. A fixed antenna adapted to operate in at least two frequency bands comprising:

a first antenna element having a substantially straight wire coupled to a feed point;

a first dielectric material completely surrounding said straight wire except where said straight wire couples to the feed point; and a second antenna element having a helical coil of a first predetermined pitch coupled to said feed point and supported by said first dielectric material.

2. The fixed antenna of claim 1 wherein said second antenna element substantially surrounds said first antenna element.

3. The fixed antenna of claim 1 further comprising an insulating sleeve surrounding said first antenna element wherein said insulating sleeve is enclosed within said first dielectric material.

4. The fixed antenna of claim 3 wherein said insulating sleeve comprises a second dielectric material having a second dielectric constant.

5. The fixed antenna of claim 4 wherein said first dielectric material has a first dielectric constant which is greater than said second dielectric constant.

6. The fixed antenna of claim 1 further comprising a matching circuit for matching said first antenna element and said second antenna element.

7. The fixed antenna of claim 6 wherein said matching circuit comprises a capacitor and an inductor.

8. The fixed antenna of claim 7 wherein said inductor further provides static protection.

9. The fixed antenna of claim 6 wherein said matching circuit further widens the bandwidth in at least one frequency band of said at least two frequency bands.

10. The fixed antenna of claim 1 wherein said first antenna element further comprises a disc at the top of said substantially straight wire.

11. The fixed antenna of claim 10 wherein said helical coil has a second predetermined pitch.

12. The fixed antenna of claim 1 further comprising a monopole common to said first antenna element and said second antenna element.

13. The fixed antenna of claim 12 wherein said helical coil and said substantially straight wire are attached to said monopole for tuning said fixed antenna.

14. A fixed antenna adapted to operate in at least two frequency bands comprising:

a first antenna element comprising a monopole antenna portion;

a second antenna element having a substantially straight wire coupled to a feed point on said first antenna portion;

a first dielectric material completely surrounding said second antenna element; and a third antenna element having a helical coil of a first predetermined pitch coupled to said feed point and supported by said first dielectric material, wherein said third antenna element substantially surrounds said first antenna element.

15. The fixed antenna of claim 14 further comprising a second dielectric material forming a sleeve surrounding said substantially straight wire and enclosed within said first dielectric material wherein said first and second dielectric material have a first and second dielectric constant, respectively, and wherein said first dielectric constant is greater than said second dielectric constant.

16. The fixed antenna of claim 14 further comprising a matching circuit for matching said second antenna element and said third antenna element, said matching circuit comprising a capacitor and an inductor.

17. A fixed antenna adapted to operate in at least two frequency bands comprising:

a whip antenna element having a substantially straight wire coupled to a feed point;

an insulative sleeve surrounding said whip antenna element wherein said insulative sleeve is comprised of a first dielectric material having a first dielectric constant;

a second dielectric material surrounding said insulative sleeve and having a second dielectric constant greater than said first dielectric constant;

a helical coil antenna element of a first predetermined pitch coupled to said feed point, wherein said helical coil antenna element substantially surrounds said whip antenna element and surrounds and is supported by said second dielectric material; and a monopole antenna element commonly coupled to said whip antenna element and said helical antenna element.

18. The fixed antenna of claim 17 further comprising a matching circuit for matching said whip antenna element and said helical antenna element, said matching circuit comprising a capacitor and an inductor.

19. A wireless communication device adapted to operate in at least two frequency bands comprising:

a transceiver having a housing;

a first antenna element having a substantially straight wire coupled to a feed point;

a dielectric material surrounding said substantially straight wire;

a second antenna element having a helical coil of a first predetermined pitch coupled to said feed point, wherein said second antenna element substantially surrounds said first antenna element and surrounds and is supported by said dielectric material;

a monopole common to said first antenna element and said second antenna element, said monopole having a threaded portion;

a threaded nut for receiving said threaded portion of said monopole; and a matching circuit for matching said first antenna element and said second antenna element, said matching circuit comprising a clip for receiving said monopole, wherein said clip acts as a feedpoint for said monopole.

* * * * *